United States Patent [19]

Schwab

[11] Patent Number: 4,866,972

[45] Date of Patent: Sep. 19, 1989

[54] RIVET SETTING TOOL FOR SETTING BLIND RIVETS

[75] Inventor: Manfred F. Schwab, Taunusstein, Fed. Rep. of Germany

[73] Assignee: Alfred Honsel Nieten-und Metallwarenfabrik GmbH, Frondenberg, Fed. Rep. of Germany

[21] Appl. No.: 227,503

[22] Filed: Aug. 2, 1988

[30] Foreign Application Priority Data

Aug. 4, 1987 [EP] European Pat. Off. ..... 87111206.6

[51] Int. Cl.[4] ..... B21D 9/05

[52] U.S. Cl. ..... 72/391; 72/453.17; 29/243.53

[58] Field of Search ..... 72/391, 453.17, 114; 29/243.53

[56] References Cited

U.S. PATENT DOCUMENTS

| | | | |
|---|---|---|---|
| 4,065,952 | 1/1978 | Holloway | 72/391 |
| 4,598,571 | 7/1986 | Oefinger | 72/391 |
| 4,648,258 | 3/1987 | Frearson | 72/453.17 |
| 4,770,023 | 9/1988 | Schwab | 72/391 |

FOREIGN PATENT DOCUMENTS

| | | | |
|---|---|---|---|
| 154280 | 9/1985 | European Pat. Off. | 72/391 |
| 2025295 | 1/1980 | United Kingdom | 72/391 |
| 2031779 | 4/1980 | United Kingdom | 72/391 |
| 2116102 | 9/1983 | United Kingdom | 72/391 |

*Primary Examiner*—David Jones

*Attorney, Agent, or Firm*—Barnes, Kisselle, Raisch, Choate, Whittemore & Hulbert

[57] ABSTRACT

In a rivet setting tool for setting blind rivets, a passage extends from the mouthpiece of the tool rearwardly through the head of the tool, for removing rivet pins which have been torn off after the rivets have been set. An axially operative setting device which can be actuated for the rivet-upsetting operation includes a piston cylinder system comprising a pneumatically operated piston and a hydraulic piston, and a compressed air feed means for actuation of the setting device and for removal of the torn-off rivet pins. The tool is operated by an actuating member which can be moved into first and second operating positions, in the first of which the actuating member opens a valve associated with the passage, for introducing compressed air into the passage for sucking in a rivet to be set, while in the second operating position the actuating member opens a valve associated with the pneumatic piston for actuating the setting device for the rivet setting operation.

10 Claims, 1 Drawing Sheet

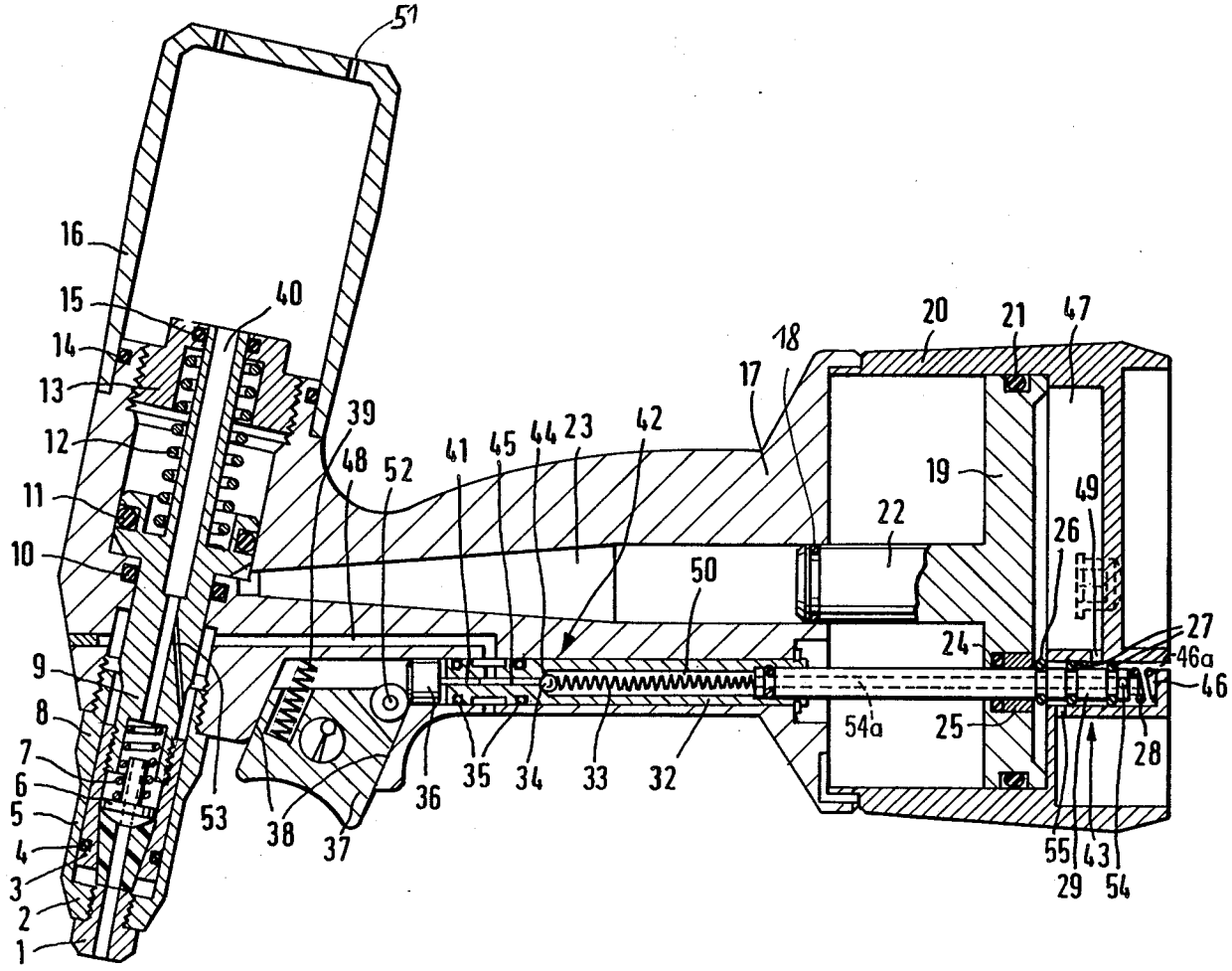
1
2
3
4
5
6
7
8
9
10
11
12
13
14
15
16
17
18
19
20
21
22
23
24
25
26
27
28
29
32
33
34
35
36
37
38
39
40
41
42
43
44
45
46
46a
47
48
49
50
51
52
53
54
54a
55

RIVET SETTING TOOL FOR SETTING BLIND RIVETS

BACKGROUND OF THE INVENTION

One form of rivet setting tool for setting blind rivets comprises a tool body with a head portion providing a mouthpiece for the blind rivets to be set, with a delivery passage extending rearwardly through the head portion of the tool body from the mouthpiece thereof for removing the rivet pins which have been torn off. The tool further comprises an axial feed arrangement which can be actuated for the rivet-upsetting operation and which includes a piston-cylinder system including a pneumatic piston and a working piston. The tool further includes a compressed air feed arrangement for actuating the feed means and for conveying the torn-off pins out of the tool.

Such a rivet setting tool requires a number of operating movements and procedures to be performed. Firstly the rivet must be sucked into position by the device and then the feed means for performing the actual riveting operation has to be actuated. Then the pin which has been torn off the set rivet has to be conveyed out of the tool into a rivet receiving container. In order to perform those various operations, the tool often involves a plurality of different actuating members which have to be operated in the appropriate sequence. Furthermore, the tool involves a continuous flow of compressed air thereto, which makes operation of the tool comparatively expensive while in addition the continuous flow of compressed air means that the tool is always making a noise as a result thereof. When the tool is taken out of operation, the compressed air flow has to be shut down by means of an additional compressed air valve.

SUMMARY OF THE INVENTION

An object of the present invention is to provide a rivet setting tool which does not suffer from the disadvantages of the tool just discussed above.

Another object of the present invention is to provide a rivet setting tool which uses a single actuating member for all the operations to be performed therewith.

Still another object of the present invention is to provide a rivet setting tool which is easy to use with a high degree of reliability and a high operating speed while avoiding the unnecessary consumption of compressed air and a continuous noise caused by the compressed air.

In accordance with the present invention, these and other objects are achieved by a rivet setting tool for setting a blind rivet, comprising a heat portion having a mouthpiece for receiving a rivet to be set, and a delivery passage which extends rearwardly through the heat portion of the tool from the mouthpiece thereof, for removal of a rivet pin which has been torn off the rivet. The tool further includes an axially operable feed or setting means for the rivet-upsetting operation, including a piston-cylinder system comprising a first pneumatic piston and a second working piston such as a hydraulic piston co-operable with the first piston, and compressed air supply means for actuation of the setting means and for conveying the torn-off pin away through the passage. An actuating member is movable into first and second operating positions, such that the first operating position provides for opening of a first valve, for the introduction of compressed air into the passage for sucking a rivet into position, while the second operating position of the actuating member provides for opening of a second valve for actuation of the rivet setting means.

In accordance with a preferred feature of the invention, the actuating member is adapted to act on a valve piston to which there is fixed a valve thrust rod operable to move a valve ball member off its valve ball seat, the valve ball member and the valve ball seat thus forming said first valve which is opened by actuation of the actuating member in that fashion.

Advantageously, the valve must thrust rod is disposed in a bore and is of smaller diameter than the bore. A compressed air supply duct leads from the bore containing the valve thrust rod to the passage for the removal of the torn-off rivet pin.

Another preferred feature of the invention provides that a compression spring urges the valve ball member towards its valve ball seat thereby to close the valve formed thereby, the compression spring being disposed in a central bore in a valve slider member.

Another advantageous feature of the invention provides that the valve piston or plunger, in the first operating position, is adapted to bear against the valve slider while in the second operating positon the valve piston or plunger moves the valve slider away from the head portion of the tool, thereby opening the valve through which compressed air passes into the chamber associated with the first pneumatic piston for actuation thereof.

Another advantageous construction provides that the valve slider is disposed in a compressed air supply duct, the inside diameter of which is larger than the outside diameter of the valve slider. A sealing means such as an O-ring, in the second operating position of the actuating member, opens a supply duct communicating with the chamber of the first pneumatic piston.

Furthermore, another advantageous feature of the invention provides that the central bore in the valve slider, in the region of a valve chamber associated therewith, is communicated by a transverse bore therewith.

In another advantageous construction the invention provides that the actuating member comprises a trigger which is guided movably against a compression spring within a suitable guide. To provide for satisfactory transmission of force from the trigger to the member to be actuated thereby, the trigger is provided with a roller which comes into contact with the valve piston or plunger on the top side thereof, that is to say the end thereof which is towards the head portion of the tool.

Further objects, features and advantages of a tool in accordance with the principles of the present invention will be apparent from the following description of a preferred embodiment thereof.

BRIEF DESCRIPTION OF THE DRAWING

The single FIGURE of the drawing is a sectional side view of a rivet setting tool according to the invention.

DESCRIPTION OF THE PREFERRED EMBODIMENT

Referring firstly to FIG. 1, shown therein is a rivet setting tool comprising a tool body portion including a head portion and a housing as indicated generally at 17. The head portion carries a mouthpiece 1 into which a blind rivet (not shown) can be fitted. Rearwardly of the mouthpiece 1, a front sleeve 2 surrounds clamping jaws as indicated at 3 and is sealed by means of an O-ring seal 4 relative to a clamping sleeve 5. A guide sleeve 6 with a compression spring 7 is carried in the sleeve 5. A rearward part 8 of the front sleeve 2 is screwed into the housing 17 of the tool.

Slidably disposed in the housing 17 is a working piston 9 illustrated in the form of a hydraulic piston which is sealed relative to the housing 17 by way of O-ring seals 10 and 11. Disposed rearwardly of the piston 9, that is to say above same in the drawing, is a strong compression spring 12 which acts on the piston 9 to urge it towards its forward position in the head portion of the tool, being the position illustrated in the drawing.

The housing 17 is closed rearwardly of the tool, that is to say upwardly in the drawing, by an end portion 13.

Extending rearwardly from the mouthpiece 1 is a delivery passage 40 which in turn opens into a pin receiving container indicated generally at 16. The container 16 is sealed forwardly by O-ring seals 14 and 15 and has two vent bores as indicated at 51.

The lower part of the housing 17, which is towards the right in the drawing, is closed off by a pneumatic piston housing indicated generally at 20. Carried slidably therein, in a cylinder cavity, is a pneumatically operable piston 19 which is sealed off relative to the housing structure by means of O-ring seal 18 and 21. An extension portion 22 of the piston 19 projects into a chamber 23 in the housing 17. The chamber 23 is of a tapering configuration towards the head portion of the tool and is in fluid communication with the hydraulic piston 9.

The tool further comprises an actuating member in the form of a trigger 37 which is carried slidably in a suitable guide 38 and can be displaced into the housing 17 against the force of a compression spring 39 urging it towards the non-actuated or outwardly projecting position shown in the drawing. The trigger 37 can be moved into first and second operating positions, as will be described hereinafter.

To provide for smooth and easy operation, the trigger 37 carries a trigger roller 52 which is positioned to come to bear against the top end, which is towards the left in the drawing, of a valve piston or plunger 36. The piston or plunger 36 has a valve thrust rod 41 which extends as far as a valve member 34 illustrated in the form of a ball member, which forms part of a valve generally indicated at 42, for controlling the supply of compressed air to the passage 40 in the head portion of the tool. The valve member 34 co-operates with a valve seat 44 which forms another part of the valve 42 and which is formed in a valve slider 32. The valve thrust rod 41 is slidable in a bore 45 which is thus of larger inside diameter than the outside diameter of the valve thrust rod 41. The valve 42 can thus close off the bore 45.

Extending from the valve thrust rod bore 45 is a compressed air passage 48 which communicates with the delivery passage 40 by way of a supply bore 53. The valve slider 32 is sealed off relative to the bore in the housing 17 in which it is disposed, by suitable O-rings 35.

The valve slider 32 also has a central bore 50 therein, in which there is disposed a compression spring 33 operable to urge the valve ball member 34 into a position of co-operating with the valve seat 44 thereof. Disposed at the lower end, which is towards the right in the drawing, of the valve slider 32 which is extended by a valve rod 29 is a valve 43 for controlling the operation of the pneumatic piston 19. A compressed air supply means communicates with a compressed air chamber 46 provided in the base of the body of the tool, with the lower end (towards the right in the drawing) of the valve rod 29 extending into the chamber 46. The compressed air chamber 46 communicates with the chamber 47 at one side of the pneumatic piston 19 by way of a supply bore 49 and by the connecting bores 54, 54*a* with the central bore 50. The valve rod 29 carries O-ring seals thereon which are arranged in such a way that in the second operating position of the trigger member 37, as referred to above, they form a communication between the compressed air supply means 46*a* into the compressed air chamber 46 through the feed bore 49, with the chamber 47 at one side of the pneumatic piston 19.

Also disposed in the compressed air chamber 46 is a compression spring 28 which thus urges the valve rod 29 and therewith the valve slider 32 upwardly in the housing 17 of the tool, that is to say towards the left in the drawing. The compressed air chamber 46 and the valve rod 29 are sealed off relative to the pneumatic piston 19, through which they extend, by way of a holding ring 25 and O-ring seals 24, 26, 27.

When the tool is connected to a compressed air source, the valve ball member 34 in association with the valve seat 44 shuts down the flow of compressed air through the compressed air feed bore 48 to the passage 40, and no air flows out of the tool. When the tool is actuated by the trigger 37 being pressed into its first operating position, the roller 52 on the trigger 37 urges the valve piston or plunger 36 downwardly in the housing 17 of the tool, that is to say towards the right in the drawing, and the valve thrust rod 41 thus moves the valve ball member 34 off the valve seat 44 thereof. As a result compressed air passes out of the bore 50 in the valve slider 32 into the bore 45 in which the valve thrust rod 41 is accommodated, and from there the compressed air flows by way of the supply bore 48 into the passage 40 so that a blind rivet (not shown) is sucked into position at the mouthpiece 1.

When the trigger 37 is urged further inwardly of the housing of the tool, in the guide 38, the movement of the roller 52 on the trigger 37 causes the valve plunger or piston 36 to be moved further downwardly in the tool, that is to say towards the right in the drawing. When the actuating member or trigger 37 reached its first operating position, the valve plunger 36 came into contact with the valve slider 32 and it now therefore moves it and therewith also the valve rod 29 downwardly in the tool, towards the right in the drawing. That provides for a communication between the compressed air feed arrangement or the compressed air chamber 46 which is filled thereby with compressed air, by way of the feed bore 49, with the chamber 47 at the right-hand side of the pneumatic piston 19. The pneumatic piston 19 is thus moved towards the left in the drawing, that is to say upwardly in the housing 17 of the tool, and thereby causes the hydraulically operated piston 9 to move rearwardly in the head portion of the tool, against the force of the compression spring 12, thus providing for upsetting of the rivet. After the riveting operation, the trigger 37 is released and returns to its first operating position. As a result the piston 9 and the piston 19 move back again to their starting positions as the compressed air feed is closed off at the valve rod 29 and a communication s made with a vent bore 55. However the valve ball member 34 is still lifted off the valve seat 44 so that the valve 42 formed thereby is in an open condition and compressed air continues to be supplied into the passage 40, so that the pin which has been torn off the set rivet can be delivered into the pin receiving container 16. When the trigger 37 has been completely released, the valve ball member 34 also moves back into its position of co-operating with the valve seat 44 and the supply of compressed air is thus completely shut down.

It will be seen from the foregoing therefore that the invention provides a blind rivet setting tool which avoids a continuous feed of compressed air into and through the tool, which results in a steady consumption of compressed air, while in pauses in operation of the tool the supply of compressed air to the tool is shut off, without a special or separate shut-off valve having to be actuated for that purpose. The tool therefore only requires a single actuating member in the form of the trigger 37, so that operation of the tool is substantially simplified. During short pauses in operation of the tool, the configuration in accordance with the invention ensures that the consumption of compressed air is shut down, which therefore also avoids the noises produced by the flow of compressed air through the tool.

It will be appreciated that the above-described embodiment of the tool according to the invention has been set forth solely by way of example of the principles thereof and that various modifications and alterations may be made therein without thereby departing from the spirit and scope of the invention.

What is claimed is:

1. A rivet setting tool for setting a blind rivet comprising a head portion providing a mouthpiece for receiving a rivet to be set, a delivery passage which extends rearwardly through the head portion of the tool away from the mouthpiece thereof, for removal of a rivet pin which has been torn off a set rivet, an axial setting means operable for the rivet-upsetting operation and including a piston-cylinder means comprising a first pneumatically operated piston and a second hydraulically operated piston, compressed air supply means for actuation of said setting means and for conveying the torn-off pin away through said passage, an actuating member movable into first and second operating positions, a first valve means adapted to be opened by said actuating member in said first position thereof, for the introduction of compressed air into said passage for sucking in a said rivet, a second valve means adapted to be opened by said actuating member in said second position thereof for actuation of said setting means, a valve plunger adapted to be displaced by said actuating member, a valve thrust rod operatively associated with said valve plunger and displaceable thereby, and a valve member co-operating with a valve seat thereby constituting said first valve means, said valve member being adapted to be lifted off its said valve seat by displacement of said valve thrust rod.

2. A tool as set forth in claim 1 wherein said valve thrust rod is disposed in a bore and is of smaller diameter than said bore, and further including a compressed air supply duct means from said bore containing said valve thrust rod to said delivery passage.

3. A tool as set forth in claim 1 and further including a passage adjacent said first valve means, a valve slider disposed in said passage and having a central bore therein, and a compression spring urging said valve member towards its said valve seat and disposed in said bore in said valve slider.

4. A tool as set forth in claim 3 wherein said valve plunger is adapted to bear against said valve slider in said first operating position of said actuating member.

5. A tool as set forth in claim 3 wherein in said second operating position of said actuating member said valve plunger is adapted to displace said valve slider thereby to open said second valve means for compressed air to pass into the chamber of said first piston for actuation thereof.

6. A tool as set forth in claim 5 and including a compressed air supply duct including said passage in which said valve slider is slidably disposed, said valve slider being of smaller transverse dimension than said passage, and further including a further supply duct communicating with said chamber of said first piston, and a sealing means adapted to open said further supply duct in said second operating position of said actuating member.

7. A tool as set forth in claim 3 wherein said second valve means includes a compressed air chamber for receiving compressed air from a compressed air source and wherein said bore in said valve slider is communicated with said compressed air chamber by way of a duct in said valve slider.

8. A tool as set forth in claim 1 wherein said actuating member comprises a trigger, a guide slidably accommodating said trigger and a compression spring acting on said trigger to urge it towards a non-actuated position.

9. A tool as set forth in claim 8 and further including a trigger roller on said trigger, to facilitate actuation thereof.

10. A tool as set forth in claim 1 wherein said actuating member comprises a trigger and a roller carried on said trigger and adapted to come into contact with said valve plunger at an axially facing face thereof upon actuation of said trigger.

* * * * *